US008033089B2

(12) United States Patent
Leupers

(10) Patent No.: US 8,033,089 B2
(45) Date of Patent: Oct. 11, 2011

(54) METHOD FOR OPERATING A TWO-FOR-ONE TWISTING OR CABLING MACHINE AND TWO-FOR-ONE TWISTING OR CABLING MACHINE

(75) Inventor: Wolfgang Leupers, Monchengladbach (DE)

(73) Assignee: Oerlikon Textile Gmbh & Co. KG, Monchengladbach (DE)

( * ) Notice: Subject to any disclaimer, the term of this patent is extended or adjusted under 35 U.S.C. 154(b) by 0 days.

(21) Appl. No.: 12/676,290

(22) PCT Filed: Jul. 30, 2008

(86) PCT No.: PCT/EP2008/006252

§ 371 (c)(1),
(2), (4) Date: Mar. 3, 2010

(87) PCT Pub. No.: WO2009/036840

PCT Pub. Date: Mar. 26, 2009

(65) Prior Publication Data

US 2010/0199625 A1 Aug. 12, 2010

(30) Foreign Application Priority Data

Sep. 12, 2007 (DE) ..... 10 2007 043 352

(51) Int. Cl.
*D01H 1/10* (2006.01)

(52) U.S. Cl. ..... 57/58.52

(58) Field of Classification Search ..... 57/58.49, 57/58.52; 242/486.4, 473.5
See application file for complete search history.

(56) References Cited

U.S. PATENT DOCUMENTS

| | | | | |
|---|---|---|---|---|
| 4,163,357 | A | 8/1979 | Greive et al. | |
| 4,180,967 | A | 1/1980 | Greive et al. | |
| 4,848,077 | A | 7/1989 | Kawarabashi | |
| 5,947,405 | A * | 9/1999 | Olischlager | 242/473.5 |
| 2001/0007339 | A1 * | 7/2001 | Flamm et al. | 242/486.4 |

FOREIGN PATENT DOCUMENTS

| | | | |
|---|---|---|---|
| DE | 23 55 079 | A1 | 5/1975 |
| DE | 27 26 603 | A1 | 12/1978 |
| DE | 38 11 667 | A1 | 10/1988 |
| DE | 38 17 678 | C1 | 7/1989 |
| DE | 20 2005 015 261 | U1 | 3/2007 |
| WO | 2007/036335 | A1 | 4/2007 |

OTHER PUBLICATIONS

Computer translation of WO 2007036335, Apr. 5, 2007, retrieved via espacenet.com.*

* cited by examiner

*Primary Examiner* — Shaun R Hurley
(74) *Attorney, Agent, or Firm* — K & L Gates LLP

(57) ABSTRACT

Method for operating a two-for-one twisting or cabling machine (1) with multiple workstations (2), each equipped with at least two feed bobbins (6, 13), one feed bobbin (6) being creeled on a spindle (3) of the workstation (2) and at least one further feed bobbin (13) being creeled on a creeling device (12) associated with the workstation (2). The yarns (7, 15) of the feed bobbins (6, 13) are guided together in a balloon yarn guide (5) and cabled, and the cabled yarn is wound to form a take-up bobbin (16). The feed bobbin (6) creeled on the spindle (3) has half the weight of the take-up bobbin (16) to be produced and the dimensions of the spindle (3) are adapted to the diameter of the reduced feed bobbin (6).

5 Claims, 2 Drawing Sheets

PRIOR ART

METHOD FOR OPERATING A TWO-FOR-ONE TWISTING OR CABLING MACHINE AND TWO-FOR-ONE TWISTING OR CABLING MACHINE

CROSS-REFERENCE TO RELATED APPLICATIONS

This application claims the benefit of German patent application 10 2007 043 352.4, filed Sep. 12, 2007, herein incorporated by reference.

FIELD OF THE INVENTION

The present invention relates to a method for operating a two-for-one twisting or cabling machine and to a two-for-one twisting or cabling machine.

BACKGROUND OF THE INVENTION

A method for operating a cabling machine of the type mentioned at the outset is known from German Patent Publication DE 27 26 603 A1. The cabling machine known from German Patent Publication DE 27 26 603 A1 has a large number of workstations, which are arranged next to one another in the longitudinal direction of the machine. The workstations in each case comprise a spindle, onto which a feed bobbin is creeled as well as a creeling device arranged on the machine frame, which is used to receive a second feed bobbin. The yarn drawn off from the feed bobbin on the creeling device is guided to a yarn guide arranged above the spindle, where it is joined to the yarn drawn off overhead from the feed bobbin creeled on the spindle. The yarn produced by this course is wound onto a take-up bobbin with a predetermined weight. The feed bobbins generally used in this production process always have the same weight, the total weight of which is above the weight which the completed take-up bobbin has. During production, a not inconsiderable quantity of yarn therefore remains on the feed bobbin creeled on the spindle, which is, however, insufficient, after the completed take-up bobbin has been replaced by an empty tube, to again wind the latter to form a take-up bobbin with the required weight. The residual feed bobbin located on the spindle is therefore removed from the spindle pot and creeled on the creeling device. The start of the yarn is connected to the yarn end of the residual feed bobbin already located there, so both feed bobbins can be unwound consecutively without an interruption. If the residual yarn quantity of the two feed bobbins is not sufficient to fill a further take-up bobbin with the desired yarn quantity, a further feed bobbin is placed on the creeling device or the residual feed bobbin which has run empty first is replaced on the creeling device by a new feed bobbin.

It has proven to be disadvantageous in this procedure that, on the one hand, a large number of operating steps is necessary to wind a take-up bobbin of a predetermined weight and that, on the other hand, residual feed bobbins remain, the yarn material of which, after the ending of a batch, have to be processed as residual bobbins or discarded.

SUMMARY OF THE INVENTION

The object of the present invention is to improve a method for operating a two-for-one twisting or cabling machine such that the operating outlay is reduced and the number of residual feed bobbins is minimised and a two-for-one twisting or cabling machine, which has a lower energy requirement.

These objects are addressed by providing a method for operating a two-for-one twisting or cabling machine having a large number of workstations, each equipped with at least two feed bobbins, one feed bobbin being creeled on a spindle of the workstation and at least one further feed bobbin being creeled on a creeling device associated with the workstation. The yarns (7, 15) of the feed bobbins (6, 13) are guided together in a balloon yarn guide (5) and cabled, and the cabled yarn is wound to form a take-up bobbin. In accordance with the present invention, the feed bobbin creeled on the spindle has half the weight of the take-up bobbin to be produced.

Further advantageous embodiments of the invention are more fully described hereinafter.

The use of feed bobbins, which have half the weight of a completed take-up bobbin, reduces the incidence of residual feed bobbins, as the feed bobbin is completely unwound at the time of completion of the take-up bobbin and is replaced together with the completed take-up bobbin. Moreover, the number of operating steps is reduced in this manner as, in each case, only the take-up bobbin and the feed bobbin on the spindle have to be replaced by an empty take-up bobbin or by a new feed bobbin. The additional step required in the prior art of introducing the residual feed bobbin into the creeling device is dispensed with here.

The creeling device should preferably be equipped with at least one feed bobbin, the total weight of which corresponds to or exceeds that of the feed bobbin to be produced.

The creeling device may preferably be equipped with at least one feed bobbin, the total weight of which is an integral multiple of the weight of the feed bobbin on the spindle. The number of operating steps can thus easily be further reduced as, for example, at twice the weight of the feed bobbin, with which the creeling device is equipped, a new feed bobbin only has to be creeled after each fourth completed take-up bobbin. In addition, the production of residual bobbins on the creeling device can thus be avoided.

In particular, the targeted adaptation of the weight of the feed bobbins, which are creeled on the spindle and the creeling device, to the weight of the take-up bobbin to be produced, reduces the number of operating steps and the residual yarn quantity within a batch. Moreover, the number of connecting points in the yarn unwound from the feed bobbin on the creeling device drops.

In order to achieve the object of providing a two-for-one twisting or cabling machine, which has a small energy requirement, it is proposed that the dimensions of the spindle are adapted to the diameter of the reduced feed bobbin. By reducing the diameter of the bobbin pot, the necessary space requirement for a workstation is reduced, so the two-for-one twisting or cabling machine can either be equipped with more workstations or has a smaller space requirement with the same productivity. A further essential advantage is the energy saving which is achieved by the diameter reduction. Along with this, the energy requirement to air condition the spaces, in which the two-for-one twisting or cabling machine according to the invention is set up, can be reduced, as, owing to the reduction of the energy consumption of the machine, the heat quantity to be dissipated is also reduced. Moreover, an increase in the service life of the mechanically stressed parts of the spindle is achieved by the reduction in the weight of the feed bobbin. A further advantage of the reduction of the spindle size is the processing of finer yarn counts at higher rotational speeds than is currently possible with conventional spindle sizes.

In particular, the external diameter of the bobbin pot may be about 235 mm and the feed bobbin creeled on the spindle may have a diameter of about 220 mm.

BRIEF DESCRIPTION OF THE DRAWINGS

Further details of the invention are described with the aid of the views in the drawing figures, in which.

DETAILED DESCRIPTION OF THE PREFERRED EMBODIMENTS

Figure 1:
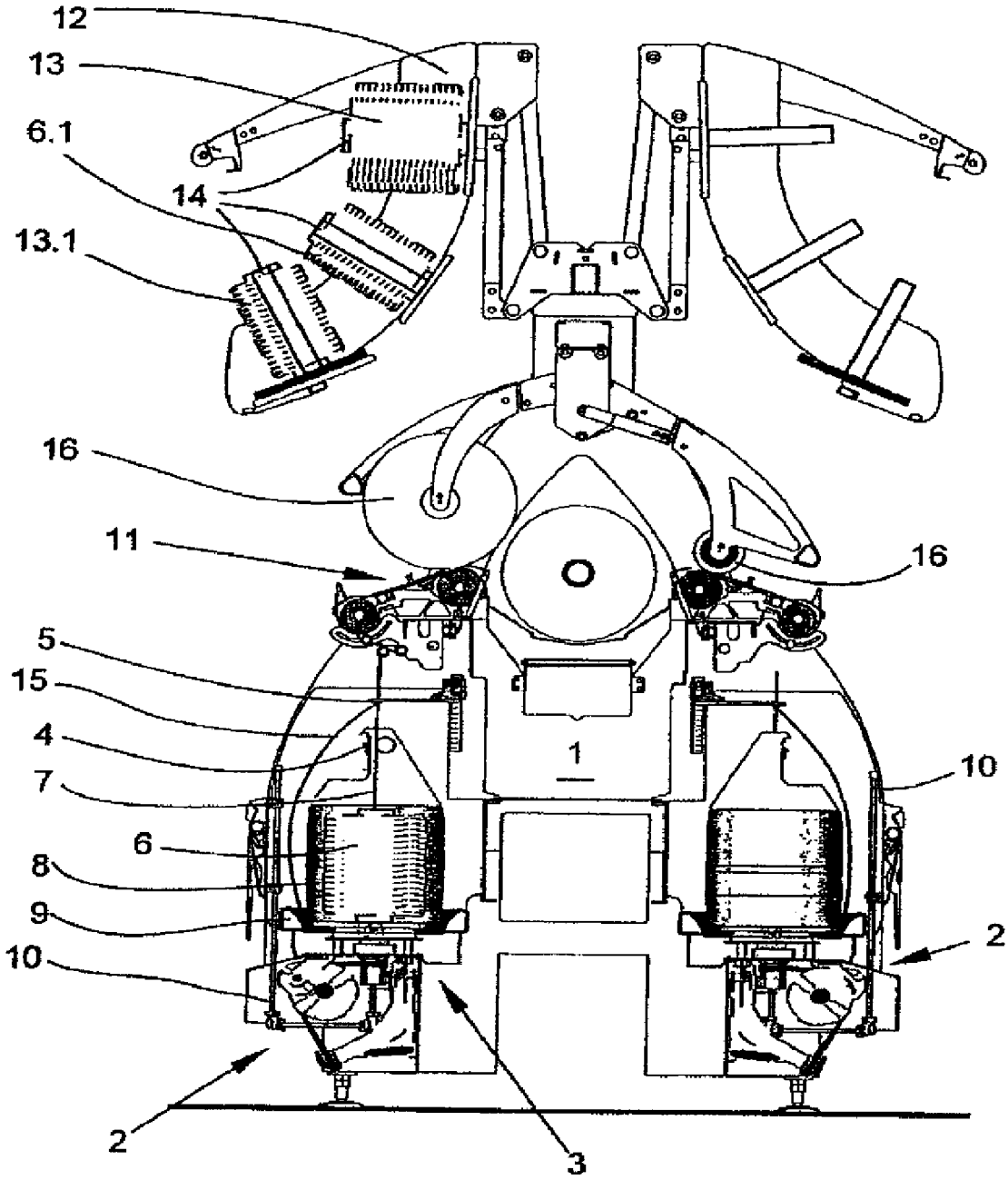
FIG. 1 shows a schematic cross-sectional view of a cabling machine equipped with feed bobbins according to the prior art.

FIG. 1 shows a schematic cross-sectional view of a cabling machine 1 which has a large number of workstations 2 arranged next to one another in the longitudinal direction of the machine. The workstations 2 in each case comprise a cabling spindle 3 with a spindle pot 8 and a drivable yarn storage disc 9 arranged below the spindle pot 8. Arranged above the cabling spindle 3 are a yarn brake 4 and a balloon guide 5. The spindle pot 8 is used to receive a first feed bobbin 6, from which a yarn 7 is drawn off overhead. The yarn 7 of the feed bobbin 6 is guided via the yarn brake 4 to the balloon guide 5. Each workstation 2 has a creeling device for feed bobbins located outside the spindle pot 8, a so-called bobbin creel 12, which is set up to receive at least a second feed bobbin 13.

For this purpose, the bobbin creel 12 has a plurality of mandrels 14. A yarn 15, which is guided axially from below through the hollow axle of the cabling spindle 3, is drawn off from a second feed bobbin 13 located on the bobbin creel 12. The yarn 15 coming from the second feed bobbin 13 is deflected in the radial direction and leaves the hollow axle of the cabling spindle 3 at the yarn storage disc 9 below the first feed bobbin 6. The yarn storage disc 9 is made to rotate by means of the cabling spindle 3. The yarn 15 leaving the yarn storage disc 9 is guided upwardly between the spindle pot 8 and a balloon limiter 10 surrounding the latter and through the balloon guide 5. The yarns 7 and 15 joined in the balloon guide 5 form a cabled double yarn, in that the yarn 15 coming from the second feed bobbin 13 winds round the yarn 7 drawn off from the first feed bobbin 6. The double yarn thus produced is fed to a winding device 11 and wound to form a take-up bobbin 16.

Initially, the method for operating the cabling machine 1 is described according to the prior art with the aid of FIG. 1. To produce a take-up bobbin 16 with the weight of 16 lbs (7.2 kg), at least two feed bobbins 6, 13 with a weight of 11 lbs (4.5 kg) are generally used. The first feed bobbin 6 is introduced into the spindle pot 8 and the second feed bobbin 13 is creeled on a mandrel 14 of the bobbin creel 12. The unwinding process of the two feed bobbins 6 and 13 ends on reaching the completion weight of the take-up bobbin 16.

At the time of completion, a total of 16 lbs of yarn have been drawn off in equal parts from the two feed bobbins 6 and 13, so two residual feed bobbins 6.1, 13.1 remain with a weight of around 3 lbs (0.9 kg). As the remaining yarn quantity on the two residual feed bobbins 6.1, 13.1 is not sufficient to complete a further take-up bobbin 16, the residual feed bobbin 6.1 is replaced in the spindle pot 8 by a new feed bobbin 6 with a full weight, while the residual feed bobbin 6.1 is creeled on a mandrel 14 of the creel 12. In addition, a further feed bobbin 13 is creeled on a mandrel 14 in the creel 12 in order to be able to supply the necessary yarn quantity of 8 lbs to the take-up bobbin 16. It is known, in this case, to connect the yarn ends and yarn starts of the individual residual feed bobbins 6.1 and 13.1 located in the bobbin creel 12 and of the new feed bobbin 13 to one another in order to be able to unwind these without an additional operator intervention.

The operating outlay which is to be attributed to the conventional type of operation of the cabling machine 1 will be described below with the aid of Tables 1a and 1b, in which the number of operating steps is shown by way of example for winding a batch with a number of six take-up bobbins 16 and a total weight of 96 lbs (57.6 kg) at a workstation 2 of the cabling machine 1.

TABLE 1a

| Operating step | Weight of the bobbin in the spindle pot [lbs] | Weight of the residual bobbin in the creel [lbs] | Weight of the second feed bobbin in the creel [lbs] | Weight of the additional feed bobbin in the creel [lbs] |
|---|---|---|---|---|
| Equipment 1 | 11 | 3 | 11 | 0 |
| Draw-off 1 | 3 | 0 | 6 | 0 |
| Equipment 2 | 11 | 3 | 6 | 0 |
| Draw-off 2 | 3 | 1 | 0 | 0 |
| Equipment 3 | 11 | 1 | 3 | 11 |
| Draw-off 3 | 3 | 0 | 0 | 7 |
| Equipment 4 | 11 | 3 | 0 | 7 |
| Draw-off 4 | 3 | 2 | 0 | 0 |
| Equipment 5 | 11 | 2 | 3 | 11 |
| Draw-off 5 | 3 | 0 | 0 | 8 |
| Equipment 6 | 11 | 3 | 0 | 8 |
| Draw-off 6 | 3 | 3 | 0 | 0 |
| Total | 11 | 3 | 3 | 11 |

Table 1a gives an overview of the equipping and draw-off steps carried out alternatingly on an individual workstation 2. In the first step designated "Equipment 1", the equipping of the cabling spindle 3 and the bobbin creel 12 is described, which is the starting situation for producing six take-up bobbins 16. For this purpose, a feed bobbin 6 with a weight of 11 lbs is located in the spindle pot 8, while a residual feed bobbin 6.1 with a weight of 3 lbs, which was previously located as a feed bobbin 6 in the spindle pot 8, and a second feed bobbin 13 with a weight of 11 lbs are creeled on the mandrels 14 in the bobbin creel 12. The second step designated "Draw-off 1" represents the conclusion of the completion of the first of six take-up bobbins 16 and the remaining residual quantities on the feed bobbin 6 in the spindle pot 8 or the feed bobbins 6.1, 13 in the bobbin creel 12. To complete the take-up bobbin 16, in each case, in equal amounts, 8 lbs are drawn off from the feed bobbin 6 and a further 8 lbs from the feed bobbins 6.1 and 13 in the bobbin creel 12. After completion of the take-up bobbin 16, in the third step "Equipment 2", the incompletely unwound feed bobbin 6 is removed from the spindle pot 8 and creeled as a residual feed bobbin 6.1 on the bobbin creel 12 and a new feed bobbin 6 inserted in the spindle pot 8. In the fourth step "Draw-off 2", a yarn quantity of 1 lbs remains on the residual feed bobbin 6.1. With the fifth step "Equipment 3", the residual feed bobbin 6.1 located in the spindle pot 8 and a further feed bobbin 13 are creeled on the bobbin creel 12 in order, for the completion of a further take-up bobbin 16, to be able to draw-off an adequate yarn quantity from the feed bobbins 6.1, 13.1, 13 in the bobbin creel 12. After the last step "Draw-off 6", a total of 96 lbs of cabled yarn, distributed over six take-up bobbins 16, have been completed. Remaining in the bobbin creel 12 here are two residual feed bobbins 6.1, 13.1 with a weight of 3 lbs each, which in the most unfavourable case cannot be utilised further, which projected over the large number of workstations 2 of the cabling machine 1 is a not inconsiderable quantity of yarn.

In the next Table 1b, the resulting number of operating steps is listed, which are required to complete the six take-up bobbins 16 each with a total weight of 16 lbs. The number of six operating steps at the spindle pot 8 is to be equated with the number of feed bobbins 6 introduced into the spindle pot 8. The number of operating steps at the bobbin creel 12 is a total of nine, which is to be attributed to the moving of the residual feed bobbins 6.1 and the equipping with a further feed bobbin 13.

TABLE 1b

| | Number of operating steps Spindle pot | Number of operating step Creel | Weight Take-up bobbin (lbs) |
|---|---|---|---|
| Equipment 1 | 1 | 2 | |
| Draw-off 1 | | | 16 |
| Equipment 2 | 1 | 1 | |
| Draw-off 2 | | | 16 |
| Equipment 3 | 1 | 2 | |
| Draw-off 3 | | | 16 |
| Equipment 4 | 1 | 1 | |
| Draw-off 4 | | | 16 |
| Equipment 5 | 1 | 2 | |
| Draw-off 5 | | | 16 |
| Equipment 6 | 1 | 1 | |
| Draw-off 6 | | | 16 |
| Total | 6 | 9 | 96 |

Proceeding from this exemplary calculation of the completion of six take-up bobbins 16 at a workstation 2, the inventive idea of the method is to be described with reference to Tables 2a and 2b. The aim of the present invention is to improve the method for operating a two-for-one twisting or cabling machine in such a way that the number of operating steps is reduced and any residual yarn quantities at the conclusion of the processing of a batch can be avoided. For this purpose, the feed bobbin 6 to be creeled on the cabling spindle 3 in each case has half the weight of the feed bobbin 16 to be produced. The advantage produced from this, in particular improved handling by a clear reduction in the number of operating steps will be described below with the aid of the number details in Tables 2a, 2b.

Moreover, the weight reduction of feed bobbin 6 on the cabling spindle 3 and, along with this, a diameter reduction of the feed bobbin 6, leads to a more favourable energy balance of the workstations 2 of the cabling machine 1 in that the spindle pots 8 are adapted to the reduced diameter of the feed bobbin 6.

TABLE 2a

| Operating step | Weight of the bobbin in the spindle pot (lbs) | Weight of the residual bobbin in the creel (lbs) | Weight of the first feed bobbin in the creel (lbs) | Weight of the additional feed bobbin in the creel (lbs) |
|---|---|---|---|---|
| Equipment 1 | 8 | 0 | 16 | 0 |
| Draw-off 1 | 0 | 0 | 8 | 0 |
| Equipment 2 | 8 | 0 | 8 | 0 |
| Draw-off 2 | 0 | 0 | 0 | 0 |
| Equipment 3 | 8 | 0 | 0 | 16 |
| Draw-off 3 | 0 | 0 | 0 | 8 |
| Equipment 4 | 8 | 0 | 0 | 8 |
| Draw-off 4 | 0 | 0 | 0 | 0 |
| Equipment 5 | 8 | 0 | 16 | 0 |
| Draw-off 5 | 0 | 0 | 8 | 0 |
| Equipment 6 | 8 | 0 | 8 | 0 |
| Draw-off 6 | 0 | 0 | 0 | 0 |
| Equipment 7 | 8 | 0 | 0 | |

As can be seen from Table 2a, owing to the equipping of the spindle pot 8 with a feed bobbin 6, the weight of which corresponds to half the weight of the take-up bobbin 8 to be completed, no residual feed bobbin 6.1 occurs, which would have to be recreeled on the creel 12 when the spindle pot 8 is reequipped in order to minimise the residual yarn quantity as has to be managed in the prior art because of the uniform dimensioning of the feed bobbins. Compared to the prior art, three operating steps are already thereby dispensed with. If, in addition, the equipping of the creel 12 with at least one feed bobbin 13 takes place, the total weight of which corresponds to that of the take-up bobbin 16 to be produced or exceeds it, the number of operating steps can be further reduced as at the earliest after each second draw-off, the feed bobbin 13 in the bobbin creel 12 has to be replaced by a new one. In particular if the total weight of the feed bobbin 13 in the creel is an integral multiple of the weight of the feed bobbin 6 in the spindle pot 8 of the cabling spindle 3, the method according to the invention can be further optimised as can be seen from Table 2b.

TABLE 2b

| | Number of operating steps spindle pot | Number of operating step creel | Weight take-up bobbin (lbs) |
|---|---|---|---|
| Equipment 1 | 1 | 1 | |
| Draw-off 1 | | | 16 |
| Equipment 2 | 1 | 0 | |
| Draw-off 2 | | | 16 |
| Equipment 3 | 1 | 1 | |
| Draw-off 3 | | | 16 |
| Equipment 4 | 1 | 0 | |
| Draw-off 4 | | | 16 |
| Equipment 5 | 1 | 1 | |
| Draw-off 5 | | | 16 |
| Equipment 6 | 1 | 0 | |
| Draw-off 6 | | | 16 |
| Total | 6 | 3 | 96 |

As can be seen in a direct comparison using the values in Tables 1b and 2b, the number of operating steps at the bobbin creel 12 is reduced from nine to three. Analogously, the method can obviously also be carried out for a take-up bobbin with another total weight. In this case, there is a dependency on the material type to be processed and the diameter resulting therefrom of the feed bobbin 6 and the spindle pot 8.

Figure 2:
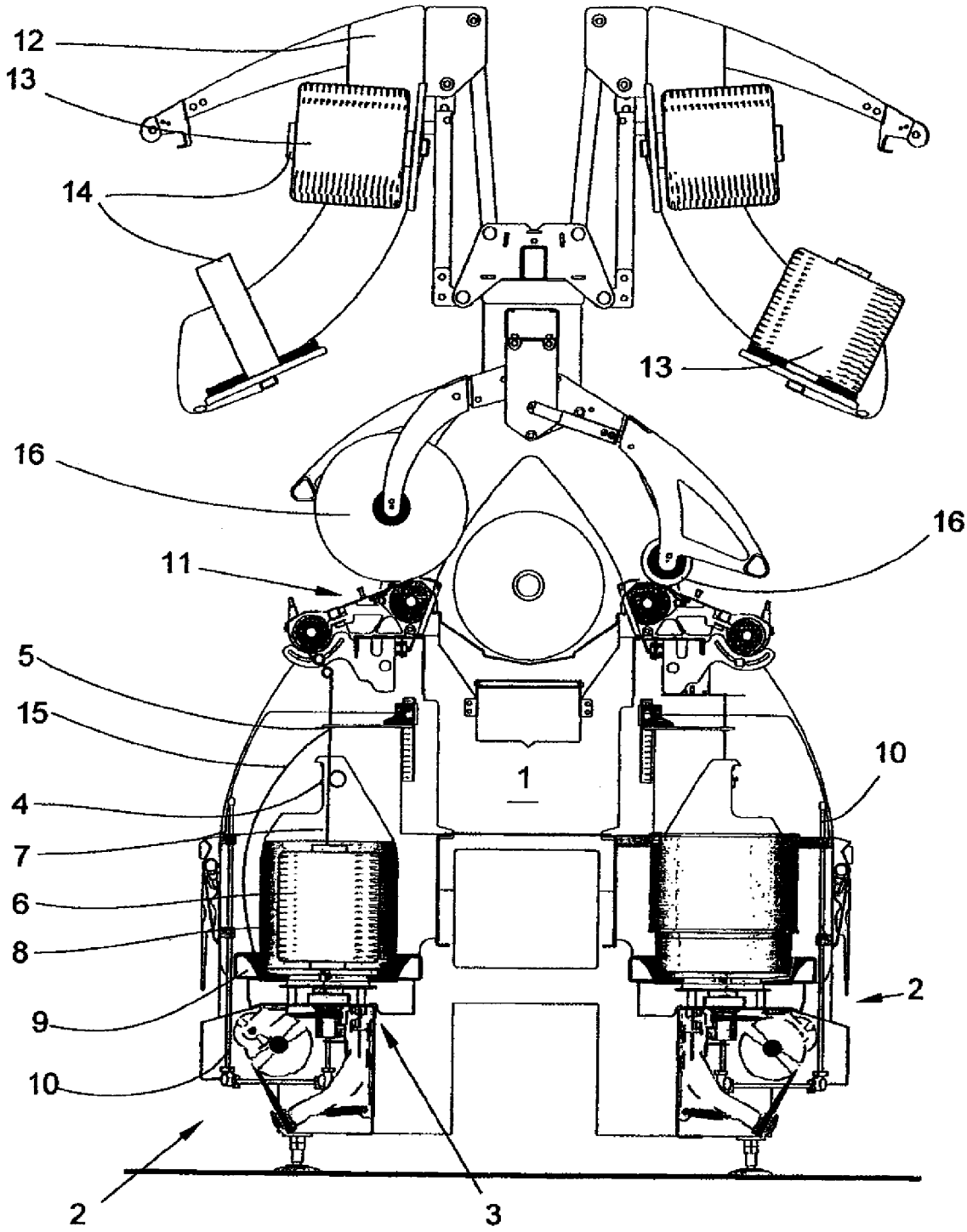
FIG. 2 shows a schematic cross-sectional view of a cabling machine equipped according to the invention with feed bobbins.

The view in FIG. 2, on the left-hand side of the cabling machine 1, shows the equipment according to the first step "Equipment 1" of the Table 2a. It is to be noted that the equipping in the creel 12 can also obviously be carried out with two feed bobbins 13 of the same weight, as is shown in FIG. 2 on the right-hand side of the cabling machine 1. In this case, the yarn end of the feed bobbin 13 to be drawn-off first is connected to the yarn start of the other feed bobbin.

Along with the reduction of the weight and the diameter of the feed bobbin 6 in the spindle pot 8, the diameter of the spindle pot 8 and the rotor is also reduced. A diameter reduction of about 30% compared to the prior art has proven to be particularly advantageous, which corresponds to an external diameter of the spindle pot 8 of about 235 mm or an internal diameter of about 225 mm, with a bobbin diameter of 220 mm.

What is claimed is:

1. Method for operating a two-for-one twisting or cabling machine (1) with a large number of workstations (2), which are each equipped with at least two feed bobbins (6, 13), one feed bobbin (6) being creeled on a spindle (3) of the workstation (2) and at least one further feed bobbin (13) being creeled on a creeling device (12) associated with the workstation (2), in that the yarns (7, 15) of the feed bobbins (6, 13) are guided together in a balloon yarn guide (5) and cabled, and in that the cabled yarn is wound to form a take-up bobbin (16), characterized in that the feed bobbin (6) creeled on the spindle (3) has half the weight of the take-up bobbin (16) to be produced.

2. Method according to claim 1, characterized in that the creeling device (12) is equipped with at least one feed bobbin (13), the total weight of which corresponds to that of the take-up bobbin (16) to be produced or exceeds it.

3. Method according to claim 2, characterized in that the creeling device (12) is equipped with at least one feed bobbin (13), the total weight of which is an integral multiple of the weight of the feed bobbin (6) on the spindle (3).

4. In combination, a two-for-one twisting or cabling machine (1) with a large number of workstations (2), and at least two feed bobbins (6, 13) at each workstation, wherein one feed bobbin (6) is creeled on a spindle (3) of the workstation (2) and at least one further feed bobbin (13) is creeled on a creeling device (12) associated with the workstation (2), in that the spindle has a spindle pot (8), into which a feed bobbin (6) is introduced, characterised in that the feed bobbin (6) creeled on the spindle (3) has half the weight of the take-up bobbin (16) to be produced and the dimensions of the spindle (3) are adapted to the weight and diameter of the feed bobbin (6).

5. The combination according to claim 4, characterized in that the external diameter of the bobbin pot (8) is about 235 mm and in that the feed bobbin (6) creeled on the spindle (3) has a diameter of about 220 mm.

* * * * *